US008321962B2

(12) United States Patent
Moyses

(10) Patent No.: US 8,321,962 B2
(45) Date of Patent: Dec. 4, 2012

(54) ADAPTER SYSTEM FOR COUPLING A PROTECTIVE MASK TO A HELMET

(75) Inventor: David Moyses, Wil (CH)

(73) Assignee: Sperian Welding Protection AG, Wattwil (CH)

( * ) Notice: Subject to any disclaimer, the term of this patent is extended or adjusted under 35 U.S.C. 154(b) by 217 days.

(21) Appl. No.: 12/707,955

(22) Filed: Feb. 18, 2010

(65) Prior Publication Data

US 2010/0223707 A1 Sep. 9, 2010

(30) Foreign Application Priority Data

Mar. 2, 2009 (CH) ..... 0302/09

(51) Int. Cl.
*A61F 9/06* (2006.01)

(52) U.S. Cl. ..... 2/8.2; 2/5; 2/9; 2/8.1; 2/422; 2/424; 2/10

(58) Field of Classification Search ..... 2/8.2, 8, 2/171.3, 5, 7, 9, 424, 436, 437, 2.6, 6.7, 410, 2/422, 411, 414, 425, 173, 185 R
See application file for complete search history.

(56) References Cited

U.S. PATENT DOCUMENTS 3,067,426 A * 12/1962 Tompkins ..... 2/8.1
4,224,694 A * 9/1980 Palmaer ..... 2/422
4,479,738 A * 10/1984 Kubnick ..... 403/329
5,373,583 A * 12/1994 Birum ..... 2/10
2006/0080761 A1 4/2006 Huh
2009/0313745 A1 * 12/2009 Kang et al. ..... 2/424

FOREIGN PATENT DOCUMENTS

| | | | |
|---|---|---|---|
| DE | 8333228 | U1 | 3/1984 |
| DE | 4132404 | A1 | 4/1993 |
| JP | 10-212618 | A | 8/1998 |
| SE | 221320 | C | 7/1968 |
| WO | 99/26502 | A1 | 6/1999 |

* cited by examiner

*Primary Examiner* — Khoa Huynh
*Assistant Examiner* — Khaled Annis
(74) *Attorney, Agent, or Firm* — Rankin, Hill & Clark LLP

(57) ABSTRACT

An adapter system for a protective mask (2) serves for movably attaching a protective mask (2) to a helmet (1), wherein the adapter system includes two individual adapters (3), which on the one hand serve for coupling to a connecting device (11) of the helmet (1) by means of a helmet coupling (31) and on the other hand for attaching to the protective mask (2) by means of a mask coupling (37), and the adapters (3) each respectively have a swivelling joint (34), around which a protective mask (2) attached to the adapter (3) is capable of being swivelled. In doing so, the adapters (3) each respectively include a swivelling arm (35) capable of being swivelled relative to the swivelling joint (34), wherein the swivelling arm (35) is adjustable in its length.

7 Claims, 3 Drawing Sheets

ADAPTER SYSTEM FOR COUPLING A PROTECTIVE MASK TO A HELMET

The invention is related to the field of protective masks. It concerns an adapter system for a protective mask and a protective mask in accordance with the preamble (generic term) of the corresponding independent claims.

PRIOR ART

An adapter system of this kind is known, for example, from WO 99/26502 A1: A protective mask by means of an adjusting mechanism is movably attached to a protective helmet ("hard hat"), and is capable of being moved from a position above the protective helmet to a working position in front of the protective helmet. The adjusting mechanism comprises a connecting arm, which from the forehead zone of the protective helmet forms a connection to the protective mask. The mechanism is complex.

Also known are adapters, which consist of a shackle extending around the protective helmet, on which the protective mask is attached and capable of being swivelled, from, for example, U.S. Pat. No. 7,409,723.

Adapter systems known up until now comprise no or else only a limited adaptability to different application situations.

DESCRIPTION OF THE INVENTION

It is therefore the object of the invention to create an adapter system for a protective mask and a protective mask of the kind mentioned initially, which eliminate the above mentioned disadvantages and which in particular comprise a simple, space-saving construction and which nonetheless are capable of being utilised in a versatile manner.

This object is achieved by an adapter system for a protective mask and a protective mask with the features of the corresponding independent claims.

The adapter system for a protective mask therefore serves to movably attach the protective mask to a helmet, wherein the adapter system comprises two individual adapters, which on the one hand are provided for coupling to a connection device of the helmet by means of a helmet coupling and on the other hand for attaching the protective mask by means of a mask coupling, and wherein the adapters respectively comprise a swivelling joint, around which a protective mask attached to the adapter is swivellable. In doing so, the adapters respectively comprise a swivelling arm swivellable relative to the swivelling joint, wherein the swivelling arm comprises an adjustable length.

As a result, therefore the distance between the swivelling joint and the protective mask is adjustable. In this manner it is possible to adjust the distance in accordance with the current utilisation of the protective mask. For example, if a fresh air supply is to be arranged on the mask in the forehead zone, it is possible to increase the distance, so that the fresh air supply has sufficient space both in the working position of the protective mask as well as in the swivelled-up condition.

In preference the adjustable swivelling arm is arranged in the kinematic chain between the swivelling joint and the mask coupling. In another embodiment of the invention the swivelling arm is arranged in the kinematic chain between the swivelling joint and the helmet coupling.

In a preferred embodiment of the invention the swivelling arm is adjustable by hand, swivelling around the swivelling joint and locking into place in at least three positions. A first one of the positions corresponds to a working position of the protective mask in front of the face of the user. A second position corresponds to a temporarily swivelled-up protective mask, for example, for checking a welding job. A third position of the swivelling arm corresponds to a position of the protective mask above the helmet, wherein in preference the centre of gravity of the protective mask in this position is at least approximately situated in a centre plane of the helmet.

This centre plane is a vertical plane through the helmet (wherein the helmet is in the normal position, corresponding to an upright head position of the person wearing the helmet), which separates a front part of the helmet from a rear part. Expressed differently, the centre plane essentially extends through the two points at the widest point on the left- and right side of the helmet as well as through the highest point or the point on top in the middle of the helmet shell. In the zone of the centre plane, on many helmets on the left and right side standardised connection slots for plugging-in ancillary devices, such as protective goggles, ear protectors, etc., are shaped.

While the protective mask is arranged in the third position vertically above the helmet, the weight of the combination of protective mask and helmet is evenly distributed. It is therefore possible to wear the combination without any asymmetrical load on the wearer, and the protection of the wearer by the helmet remains preserved.

In a preferred embodiment of the invention, when the adapters are attached to a helmet, the swivelling axis of the swivelling joint runs behind a centre plane of the helmet. In case of a typical helmet this also signifies, that the swivelling axis of the swivelling joint runs behind the attaching devices of the helmet, in which the adapters are fixed. At the same time, in preference also the swivelling axis of the swivelling joint runs below the connecting devices. One or all of these measures lead to the consequence, that the radius, around which the protective mask is swivelled, is comparatively large. This in turn makes it possible, that the protective mask, irrespective of the precise contour of the helmet, is capable of being swivelled past the helmet. As a result of this, a very diverse combination of protective masks is possible.

A length adjustment of the swivelling arm in accordance with a preferred embodiment represents a further possibility of increasing the swivelling radius in this sense.

In a further preferred embodiment of the invention the adapters each comprise an adjusting joint, around which the swivelling joint is able to be swivelled relative to the helmet coupling. With this, it becomes possible to carry out a fine adjustment of the relative position of the protective mask to the helmet, this in particular in order to adjust the working position in correspondence with the preferences of the wearer.

The adapter system in accordance with the invention is capable of being implemented as a separate set with two adapters, or else it is possible to manufacture a protective mask with an adapter system according to the invention already installed.

Further preferred embodiments follow from the dependent claims.

BRIEF DESCRIPTION OF THE DRAWINGS

Hereinafter the object of the invention is explained in more detail on the basis of a preferred embodiment, which is illustrated in the enclosed drawings. These depict.

Figure 1:
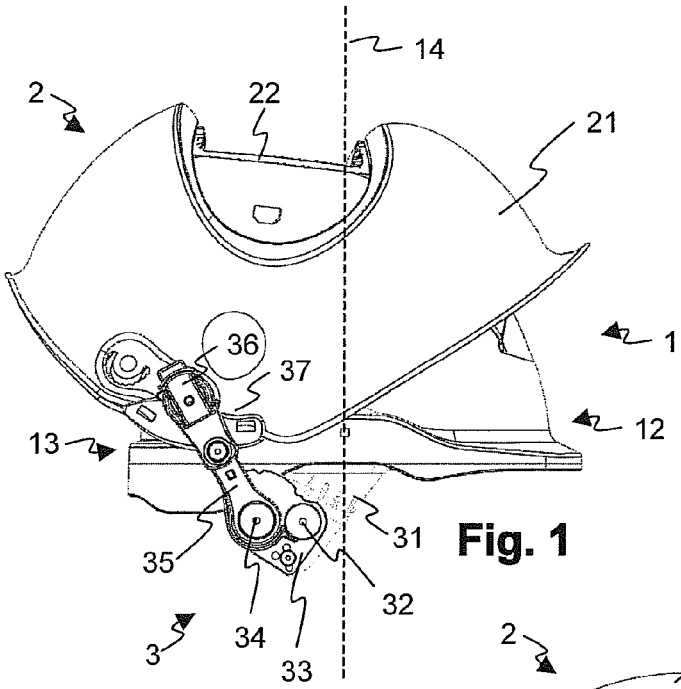
FIGS. 1-3 Views of a protective helmet with a protective mask and an adapter system in accordance with the invention in different positions.

The reference marks utilised in the drawings and their significance are listed in summary in the list of reference marks. On principle in the Figures the same components are identified with the same reference marks.

WAYS TO IMPLEMENT THE INVENTION

The FIGS. 1 to 5 illustrate different views of a helmet 1 with a protective mask 2, which are connected to one another with an adapter system comprising two adapters 3. The helmet 1 typically is a protective helmet of a known type with a plastic shell and with a wearing system with a band extending around the head of the wearer (not depicted). The precise shape of the helmet is usually defined by national safety standards. As a rule, a helmet 1 on both sides, approximately at the widest point or in the middle between the front side 12 and the rear side 13 of the helmet 1, comprises standardised connecting slots 11 for plugging-in ancillary devices. This middle of the helmet also corresponds to a centre plane 14, which extends through the middle of the helmet, respectively, the head of the person, who is wearing the helmet. As a rule, also the highest point of the helmet or of the head is situated at least approximately in the centre plane 14.

The protective mask 2, for example, a welder's protective mask, among others comprises a mask body 21, with a viewing window 22 embedded in it. The viewing window 22 typically comprises a protection glass or an automatically darkening filter.

An adapter 3 forms an adjustable kinematic chain between helmet 1 and protective mask 2. At one end of this chain the adapter 3 with a helmet coupling 31 in each case is plugged into one of the connection slots 11, at the other end it is firmly connected with a mask coupling 37 and as a rule detachably with the protective mask 2. Respectively two adapters 3, which are mirror symmetrical to one another and which are able to be plugged into the connection slots 11 on the left and right of the helmet 1, form an adapter system.

The helmet coupling 31 is designed corresponding to a standardised form of the connecting slot 11. As a result of this, for a certain market only the type of helmet coupling 31 has to be adapted, and the other parts of the adapter 3 are able to remain unchanged. In preference, the adapter 3 is capable of being plugged and is plugged into the connection slot from underneath.

Figure 5:
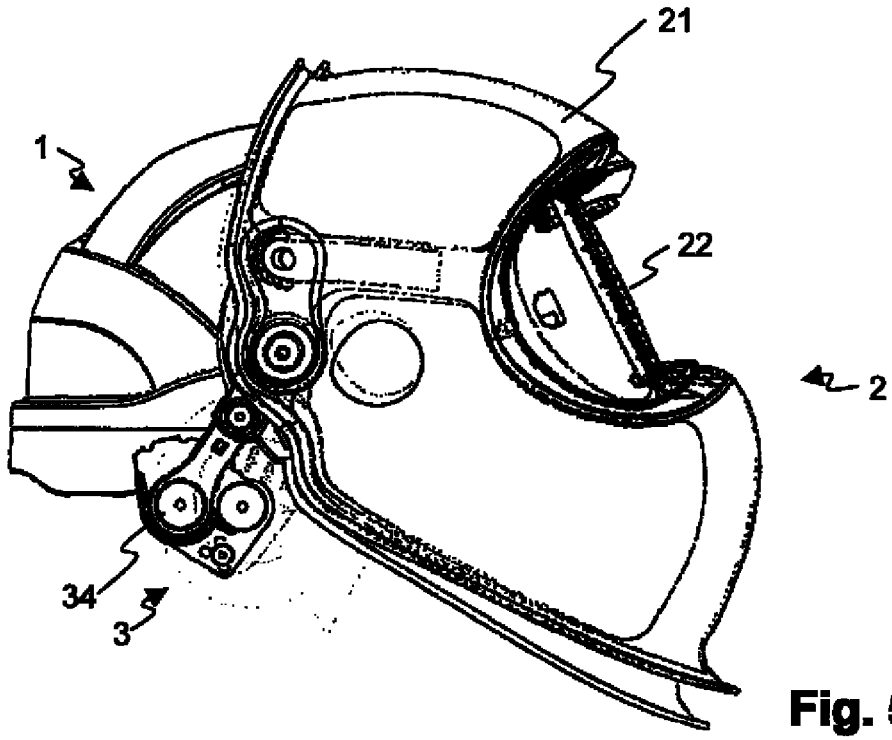
FIG. 5 schematically an adjustment of an adjusting joint.

In the kinematic chain between the helmet coupling 31 and the mask coupling 37 are located, preferably in this sequence: An adjusting element 33, a swivelling arm 35 and an adjusting element 36. These are movable or adjustable relative to one another in the following manner:

The adjusting element 33 is adjustable swivellable relative to the helmet coupling 31 (FIG. 5). As a result a basic angle between the helmet 1 and the protective mask 2 is adjustable, which has an effect on all positions of the protective mask 2. In particular, with this it is possible for a desired position of the protective mask 2 in a working position to be adjusted. In the depicted embodiment of the invention the adjustment of the adjusting element 33 is effected by sections of the adjusting element 33 and the helmet coupling 31, which both respectively are equipped with holes and which are capable of being fixed in different orientations with a screw through the holes. This adjustment as a rule does not require a tool and is rarely carried out, for example, for adapting the system of helmet 1 and protective mask 2 to a user.

The swivelling arm 35 is adjustable in a manner swivellable around a swivelling joint 34 relative to the adjusting element 33, and in a locking manner. The locking takes place, for example, by means of a locking element 40, which:

- is resiliently arranged on the swivelling arm 35,
- when swivelling the swivelling arm 35, slides along a path 38 on the adjusting element 33, and
- locks in grooves 39 in this path 38, corresponding to the locking positions of the adapter 3 or, respectively, of the protective mask 2.

Figure 2:
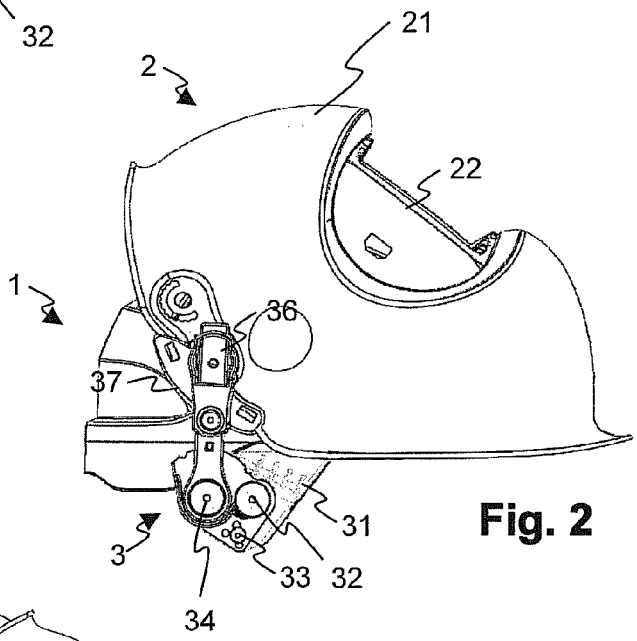
Figure 3:
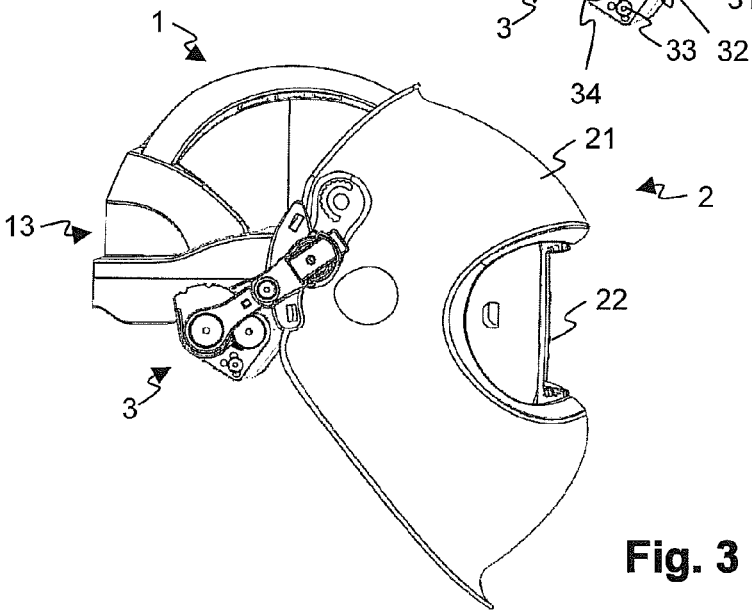

This adjustment takes place manually and very frequently when working with the system. In doing so, the protective mask 2 is adjusted between a working position (FIG. 3) and a middle position (FIG. 2). In preference, there is also another position (FIG. 1), in which the protective mask 2 is in a balanced position, with respect to its weight, above the helmet 1, so that the system comprising helmet 1 and protective mask 2 in case of a longer non-utilisation of the protective mask 2 is comfortable to wear.

Figure 4:
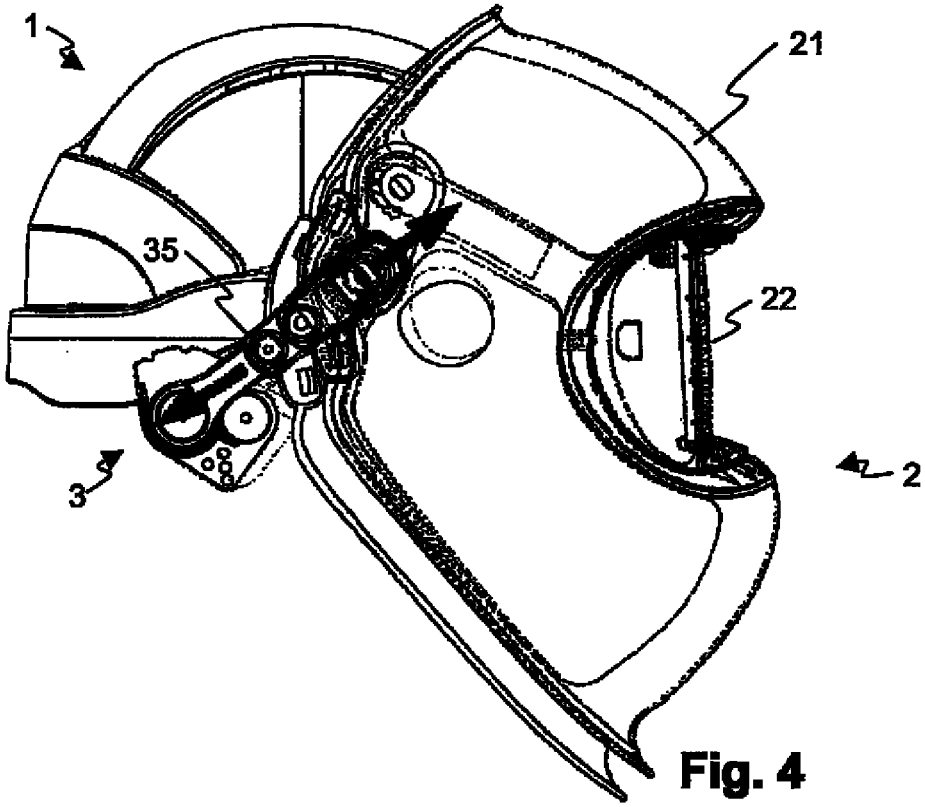
FIG. 4 schematically a length adjustment of a swivelling arm.

The adjusting element 36 is displaceable along the swivelling arm 35 (FIG. 4). Fixedly connected with the adjusting element 36 fest, or else formed as a single piece with the adjusting element 36, is the mask coupling 37 for attaching the adapter 3 to the protective mask 2. By displacing the adjusting element 36, a radius of the swivelling movement of the swivelling arm 35 and with this of the protective mask 2 is adjusted. The adjustment can be done manually or by means of a lock or attachment that is releasable with a tool. This adjustability enables a more flexible utilisation of the same adapter type with helmets differing in size, as well as the adaptation to differing utilisations of a helmet 1 with protective mask 2, for example, in combination with a fresh air supply.

The fulcrum or the swivelling axis of the swivelling joint 34 is located (relative to the orientation of the helmet 1 or, respectively, to the head of the wearer of the helmet) behind and in preference also below the helmet coupling 31. As a result, the length of the swivelling arm 35 or the radius of the swivelling movement of the protective mask 2 is generally lengthened, and a positioning of the protective mask 2 in a balanced position above the helmet is made more easy.

Figure 6:
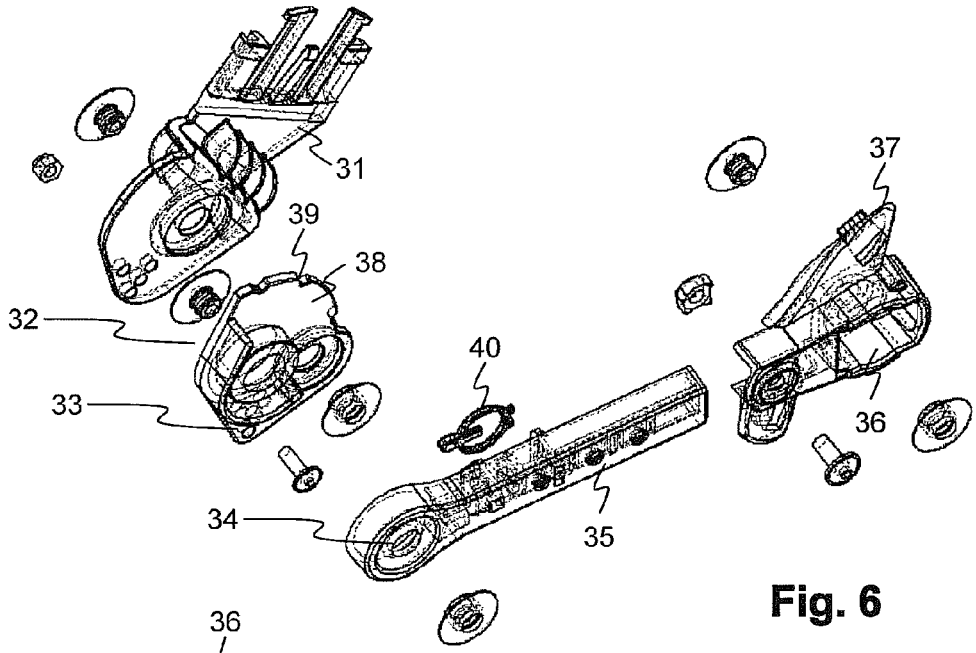
FIG. 6 an exploded view of an adapter.
Figure 7:
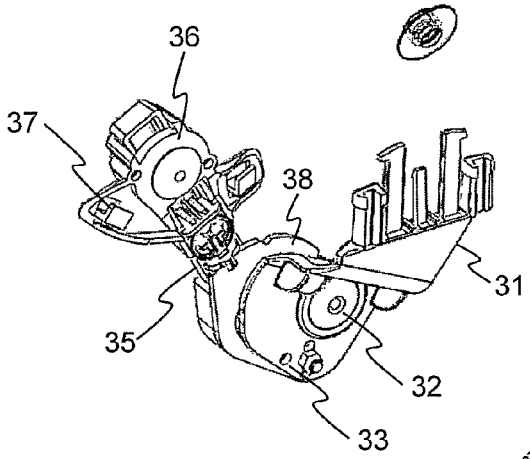
FIG. 7 an adapter system comprising two adapters.
Figure 7:
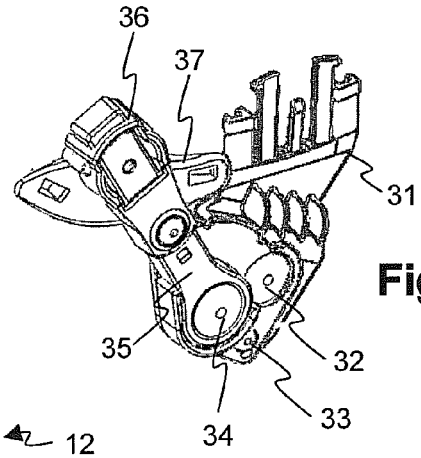
Figure 8:
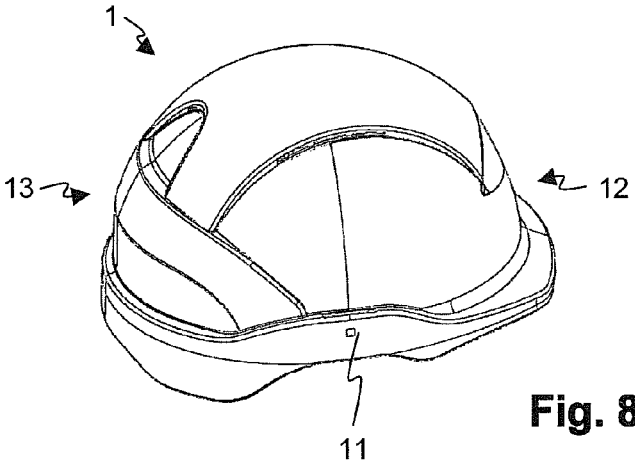
FIG. 8 a helmet.

FIG. 6 illustrates an exploded view of an adapter with the already described components, and FIG. 7 an adapter system made out of two adapters mirror-symmetrical to one another. FIG. 8 depicts a helmet 1 with, visible on one side, a connecting slot 11. A second connecting slot 11 is arranged relative to the longitudinal axis of the helmet symmetrically to it on the other side of the helmet 1.

LIST OF REFERENCE MARKS

1 Helmet
11 Connecting slot/device
12 Front side
13 Rear side
14 Centre plane
2 Protective mask
21 Mask body
22 Viewing window
3 Adapter
31 Helmet coupling
32 Adjusting joint
33 Adjusting element
34 Swivelling joint
35 Swivelling arm
36 Adjusting element
37 Mask coupling

38 Path
39 Locking grooves
40 Locking element

The invention claimed is:

1. An adapter system for a protective mask, for a movable attachment of the protective mask to a helmet, wherein the adapter system comprises:

two individual adapters, which on the one hand are provided for coupling to a connecting slot of the helmet by means of a helmet coupling and on the other hand for the attaching to the protective mask by means of a mask coupling, wherein the adapters each comprise a swivelling joint around which a protective mask attached to the adapter is capable of being swivelled, wherein the adapters each respectively comprise a swivelling arm capable of being swivelled relative to the swivelling joint, and the swivelling arm is adjustable in its length, wherein the swivelling arm is manually adjustable by swivelling around the swivelling joint, locking in at least three positions, wherein the adapters each respectively comprise an adjusting joint, around which the swivelling joint is capable of being swivelled relative to the helmet coupling, wherein an axis of rotation of the swivelling joint and an axis or rotation of the adjusting joint are not coaxial, wherein one of the locking positions of the swivelling arm corresponds to a position of the protective mask above the helmet and the center of gravity of the protective mask in this position at least approximately lies in a center plane of the helmet, and wherein the center plane is a vertical plane through the helmet when the helmet is in a position corresponding to an upright head position of a person wearing the helmet, the center plane extending through the middle of the helmet and separating a front part of the helmet from a rear part of the helmet.

2. The adapter system according to claim 1, wherein the adjustable swivelling arm is arranged in a kinematic chain between the swivelling joint and the mask coupling.

3. The adapter system according to claim 1, wherein the adjustable swivelling arm is arranged in a kinematic chain between the swivelling joint and the helmet coupling.

4. The adapter system according to claim 1, wherein, when the adapters are attached to a helmet, the swivelling axis of the swivelling joint runs behind a centre plane of the helmet.

5. The adapter system according to claim 1, wherein, when the adapters are attached to a helmet, the swivelling axis of the swivelling joint runs behind the connecting devices of the helmet, in which the adapters are fixed.

6. The adapter system according to claim 1, wherein, when the adapters are attached to a helmet, the swivelling axis of the swivelling joint runs below the connecting devices of the helmet, in which the adapters are fixed.

7. Protective mask, comprising an adapter system according to claim 1.

* * * * *